US008534827B2

(12) United States Patent
Hoshi et al.

(10) Patent No.: US 8,534,827 B2
(45) Date of Patent: Sep. 17, 2013

(54) IMAGE FORMING APPARATUS

(75) Inventors: Akimitsu Hoshi, Kawasaki (JP); Yoshiaki Murayama, Tokyo (JP); Yasuhiko Ikeda, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 12/965,134

(22) Filed: Dec. 10, 2010

(65) Prior Publication Data

US 2011/0211011 A1 Sep. 1, 2011

(30) Foreign Application Priority Data

Feb. 26, 2010 (JP) ..... 2010-042351

(51) Int. Cl.
*B41J 2/01* (2006.01)

(52) U.S. Cl.
USPC ..... 347/104; 347/101; 347/102

(58) Field of Classification Search
USPC ..... 347/5, 9, 14, 15, 19, 101, 102, 104
See application file for complete search history.

(56) References Cited

U.S. PATENT DOCUMENTS

2002/0171726 A1* 11/2002 Ishii et al. ..... 347/101
2007/0008394 A1* 1/2007 Mashima ..... 347/104

FOREIGN PATENT DOCUMENTS

JP 3674577 B2 7/2005
JP 2006-340406 A 12/2006
JP 2007-230171 A 9/2007

* cited by examiner

*Primary Examiner* — Lam S Nguyen
(74) *Attorney, Agent, or Firm* — Canon USA Inc. IP Division

(57) ABSTRACT

The present invention is directed to an image forming apparatus including a supply unit configured to supply a sheet, a recording unit configured to perform recording by discharging a plurality of colors of inks onto the sheet, a reading unit configured to read out an image of the sheet, a drying unit configured to dry the sheet on which recording is provided by the recording unit, and a control unit configured to perform control so as to record an inspection pattern onto the sheet by the recording unit and so as to readout the inspection pattern of the sheet by the reading unit after the sheet on which the inspection pattern is recorded passes through the drying unit in order to acquire inspection data of the inspection pattern of the sheet.

15 Claims, 18 Drawing Sheets

IMAGE FORMING APPARATUS

BACKGROUND OF THE INVENTION

1. Field of the Invention

The present invention relates to an ink-jet printing type image forming apparatus.

2. Description of the Related Art

In the conventional image forming apparatus, an inspection pattern is recorded on a sheet and the recorded inspection pattern is read out by a built-in scanner, thereby performing detection of defective discharge of ink and measurement of impact precision of ink, i.e., measurement of registration. Further, in the conventional image forming apparatus, the inspection pattern is recorded and the recorded inspection pattern is readout by the scanner in order to detect a tint, thereby acquiring data for correcting a color, i.e., controlling of a discharged ink amount.

In a case where a defective discharge or impact precision are measured, the inspection pattern can be detected by the built-in scanner since color reproductivity is not required so much. However, in a case where inspection data for head shading, color shading, or a pulse width modulation (PWM) control is acquired, to dry the ink of the recorded inspection pattern is essential in order to detect the tint. Conventionally, in a case where the inspection pattern for detecting the tint is recorded, the inspection pattern is taken out to the outside of the printer in order to completely dry the inspection pattern with an outside air, followed by reading out the dried inspection pattern by an external scanner.

For example, Japanese Patent Registration No. 3674577 discusses a technique for measuring the defective discharge and the impact precision by using a scanner built in the printer.

In a case where the inspection pattern is printed for the sake of acquirement of inspection data to adjust the tint of a print target image in the image forming apparatus, the inspection pattern needs to be read out by using a scanner after ink is dried. Therefore, such processing requires time and human hand.

To perform the above described processing, an external scanner is required and a user needs to learn a complex operation thereof. Further, requirement of the manpower means that it is not possible to activate the image forming apparatus at a scheduled time determined with a timer and automatically print out the inspection pattern.

SUMMARY OF THE INVENTION

The present invention is directed to an image forming apparatus in which data for adjusting a tint is acquired automatically. According to an aspect of the present invention, data for adjusting the tint of the image forming apparatus can be automatically acquired.

According to another aspect of the present invention, an image forming apparatus includes a supply unit configured to supply a sheet, a recording unit configured to perform recording by discharging a plurality of colors of inks onto the sheet, a reading unit configured to read out an image of the sheet, a drying unit configured to dry the sheet on which recording is provided by the recording unit, and a control unit configured to perform control so as to record an inspection pattern onto the sheet by the recording unit and so as to read out the inspection pattern of the sheet by the reading unit after the sheet on which the inspection pattern is recorded passes through the drying unit in order to acquire inspection data of the inspection pattern of the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of an ink-jet printing type image forming apparatus is described below. The image forming apparatus according to the present invention uses a long continuous sheet (i.e., a continuous sheet having a length longer than a length of repetitive print units (i.e., a unit image) in a conveyance direction) and includes a high speed line printer that can be used in both of one-sided printing and two-sided printing. The image forming apparatus according to the present invention is suitable for a field in which the large number of pages is printed, for example, a print laboratory. The present invention can be widely applied to an image forming apparatus such as a printer, a printer multifunction peripheral, a copying machine, a facsimile machine, and a manufacturing apparatus of various devices. Further, the present invention can be applied to a sheet processing apparatus for providing not only printing processing but also various processing (e.g., recording, processing, applying, radiating, reading out, and inspecting) onto a roll sheet.

Figure 1:
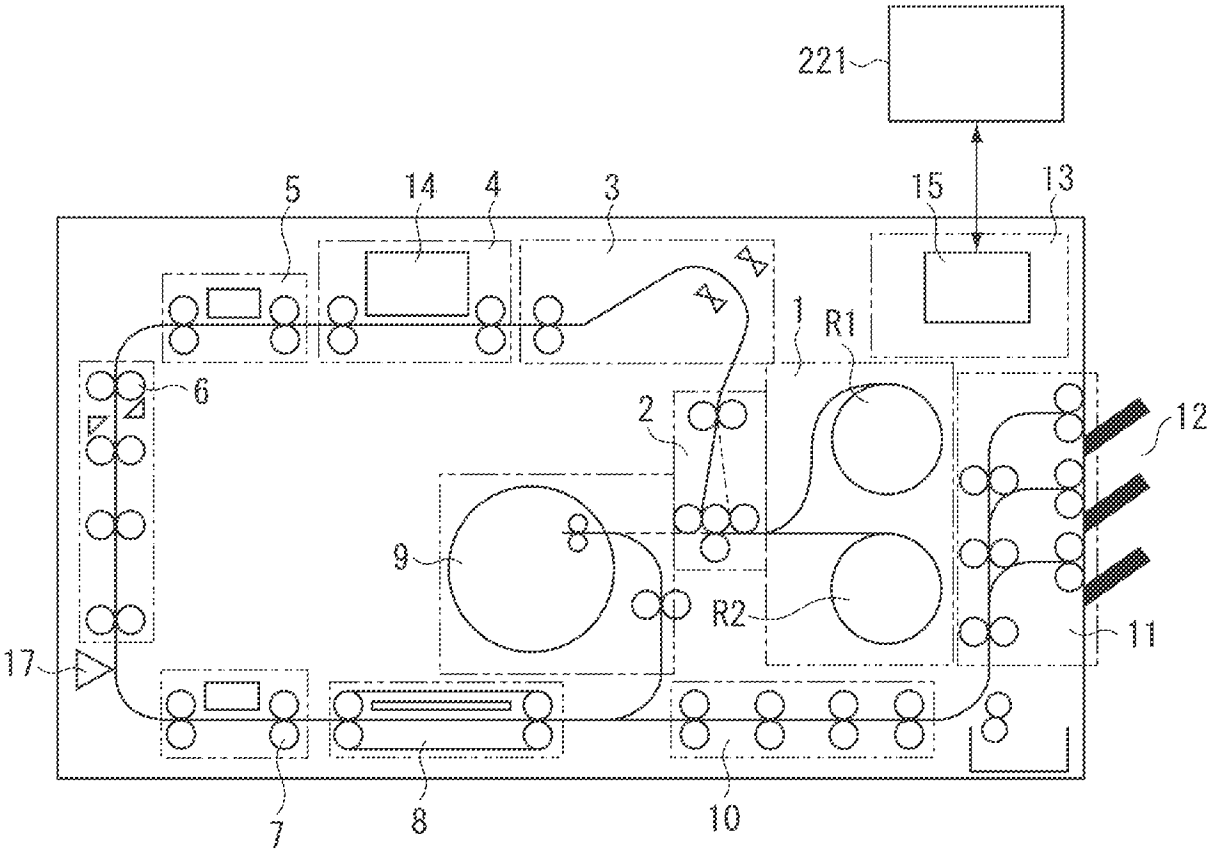
FIG. 1 is a schematic view illustrating an internal configuration of an image forming apparatus.

FIG. 1 is a schematic view of a cross section illustrating an internal configuration of the image forming apparatus. The image forming apparatus according to the present exemplary embodiment can perform the two-sided printing, i.e., can print on a first surface of a sheet and a second surface of the sheet opposite to the first surface, by using the roll sheet. The image forming apparatus mainly includes therein a sheet supply unit 1, a decurling unit 2, a skew correction unit 3, a print unit 4, an inspection unit 5, a cutter unit 6, an information recording unit 7, a drying unit 8, a reversing unit 9, a discharge conveyance unit 10, a sorter unit 11, a discharge unit 12, and a control unit 13. A sheet is conveyed by a conveyance mechanism including roller pairs and belts provided along a sheet conveyance path which is illustrated by a solid line in FIG. 1. The sheet is processed in each of the units while the sheet is conveyed. At an arbitrary position in the sheet conveyance path, a side near to the sheet supply unit 1 is referred to as an "upstream", whereas the other side of the sheet supply unit 1 is referred to as a "downstream".

The sheet supply unit (i.e., supply unit) 1 is configured to hold and supply the rolled up continuous sheet. The sheet supply unit 1 is configured to be capable of holding two rolls R1 and R2 and pull out the sheet selectively for supply. The number of rolls to be held by the sheet supply unit 1 is not limited to two, but may be one or more than three.

The decurling unit 2 is configured to reduce curling (i.e., a warpage) of the sheet supplied from the sheet supply unit 1. In the decurling unit 2, two pinch rollers are used corresponding to one driving roller, thereby causing the sheet to be curved and passed therebetween while a reversed warpage is provided to the sheet. With the above described mechanism, a decurling force contributes to reduce the curling of the sheet.

The skew correction unit 3 is configured to correct skew (i.e., an inclination of the sheet with respect to an original travelling direction) of the sheet passed through the decurling unit 2. Pressing a sheet end of a reference side against a guide member contributes to correct the skew of the sheet.

The print unit 4 is a sheet processing unit for forming an image by providing printing processing with a print head 14 onto the sheet from the above, while the sheet is conveyed. In other words, the print unit 4 is configured to perform a prescribed processing onto the sheet. The print unit 4 further includes a plurality of conveyance rollers for conveying the sheet. The print head 14 as a recording unit includes a line print head including rows of ink-jet printing type nozzles formed thereon in a range covering the maximum width of the sheet that is to be used. The print head 14 includes a plurality of print heads arranged in parallel with each other in a conveyance direction in order to discharge a plurality of colors of inks. In the present exemplary embodiment, the print head 14 includes seven print heads corresponding to seven colors, i.e., C (cyan), M (magenta), Y (yellow), LC (light cyan), LM (light magenta), G (gray), and K (black). Each of the print heads includes a plurality of ink orifice for discharging inks. The number of colors and the number of print heads, respectively, is not limited to seven. The ink-jet printing type image forming apparatus may adopt methods utilizing a heating element, a piezo element, an electrostatic element, or a microelectricalmechanical system (MEMS) element. The inks of each color are supplied to the print head 14 from the ink tank through the ink tube respectively.

Figure 2:
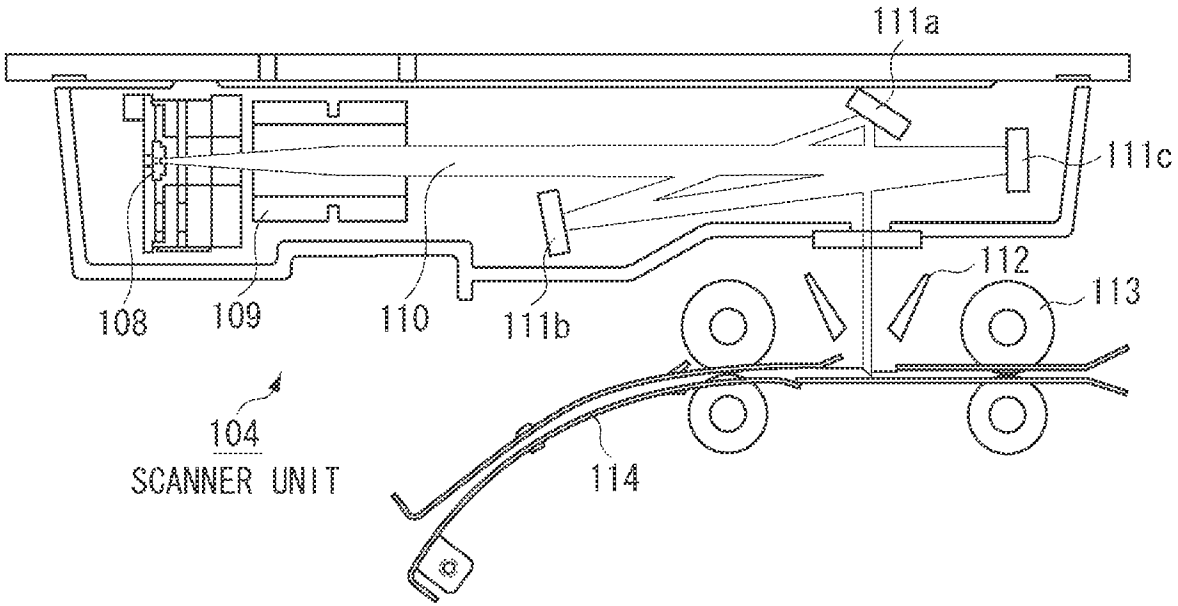
FIG. 2 illustrates a detailed configuration of a scanner unit.

The inspection unit 5 is configured to optically read out an inspection pattern and an image printed on a sheet by the print unit 4 to inspect a nozzle state of the print head, a sheet conveyance state, an image position, and the like. The inspection unit 5 includes a scanner unit 104 as a reading unit for actually reading out the image and an image analysis unit 107 (illustrated in FIG. 5) that analyzes thus read-out image to return the analysis result to the print unit 4. FIG. 2 illustrates the scanner unit 104 in detail. The scanner unit 104 includes a charge coupled device (CCD) 108 for converting light into an electric signal, a lens 109, light beam 110 indicating a light path from a document to the CCD 108 through the lens 109, and mirrors 111*a*, 111*b*, and 111*c* for folding the light beam 110 in a narrow space. The scanner unit 104 further includes a document 112 for illuminating the document, conveying rollers 113 for conveying the document, and a paper conveyance guide plate 114 for guiding the document. The document guided by the paper conveyance guide plate 114 passes through the reading unit at a predetermined speed by the conveyance rollers 113. The document located at the reading unit is illuminated by the document illumination unit 112. The light from the illuminated document is folded by the mirrors 111*a*, 111*b*, and 111*c* and thereafter is collected to the CCD 108 through the lens 109. Image information converted into an electric signal by the CCD 108 is transmitted to the image analysis unit 107, where the image information is analyzed.

The cutter unit 6 is configured to include a mechanical cutter for cutting the sheet after being printed into a predetermined length. The cutter unit 6 also includes a plurality of conveyance rollers for sending the sheet out to the next processing.

The information recording unit 7 is configured to record print information (i.e., unique information) such as a serial number and date in a non-print area of the cut sheet. Recording is performed by printing characters and codes using an ink-jet printing type or a heat transfer type image forming apparatus. At a position between an upstream side of the information recording unit 7 and a downstream side of the cutter unit 6, there is provided a sensor 17 for sensing a leading edge of the cut sheet. In other words, the sensor 17 detects an end of the sheet between the cutter unit 6 and a recording position according to the information recording unit 7. The information recording unit 7 controls timing for recording information based on detection timing of the sensor 17.

The drying unit 8 is configured to heat the sheet after being printed by the print unit 4 and to cause ink applied on the sheet to be dried within a short period of time. Within the drying unit 8, hot air is applied at least from a lower surface side of the sheet that is passing through the drying unit 8 in order to dry an ink-applied surface. A drying method is not limited to the hot air applying method but may be a method of irradiating a sheet surface with an electromagnetic wave (e.g., ultraviolet rays and infrared rays).

A sheet conveyance path from the above described sheet supply unit 1 to the drying unit 8 is referred to as a first path. The first path has a shape to make U-turn from the print unit 4 to the drying unit 8. The cutter unit 6 is located on the way of the U-turn shape.

The reversing unit (i.e., a holding unit) 9 is configured to temporarily take up the continuous sheet, of which front surface has been printed, when two-sided printing is performed, to reverse the sheet by drawing the sheet again from the reversing unit 9. The reversing unit 9 is provided on the way of a loop path (hereinafter referred to as the "second path") from the drying unit 8 to the print unit 4 through the decurling unit 2 in order to resupply the sheet passed through the drying unit 8 to the print unit 4. The reversing unit 9 includes a take-up rotator (i.e., a drum 9*a*) which rotates in order to take up the sheet. The continuous sheet of which front surface is printed but which is not cut yet is temporarily taken up by the take-up rotator. After the continuous sheet is taken up, the take-up rotator is reversely rotated and thereby sends out the taken up sheet inversely. Accordingly, the continuous sheet is supplied to the decurling unit 2. Subsequently, the sheet is further conveyed to the print unit 4. Since this sheet is reversed, printing can be provided to a rear side of the sheet by the print unit 4. Two-sided printing is described below in detail.

The discharge conveyance unit 10 is configured to convey the sheet, that is cut by the cutter unit 6 and dried by the drying unit 8, to the sorter unit 11. The discharge conveyance unit 10 is provided in a path (hereinafter referred to as the "third path") different from the second path including the reversing unit 9. In order to selectively guide the sheet conveyed along the first path to one of the second path or the third path, a path switch mechanism having a movable flapper is provided at a diverging position of the path.

The sorter unit 11 and the discharge unit 12 are provided at a side portion of the sheet supply unit 1 and an end of the third path. The sorter unit 11 is configured to sort the printed sheets into groups, as required. Thus sorted sheets are discharged to the discharge unit 12 including a plurality of trays. As described above, the third path has such a layout that the third path passes below the sheet supply unit 1 and discharges the sheet to an opposite side of the print unit 4 and the drying unit 8 across the sheet supply unit 1.

The control unit 13 is configured to control each of the units of the entire printing apparatus. The control unit 13 includes a central processing unit (CPU), a storage unit, various types of control units, an external interface, and an operation unit 206 through which the user performs an input operation and an output operation. An operation of the printing apparatus is controlled based on a command from a controller or a host device 16 such as a host computer which is connected to a controller through an external interface.

Figure 3:
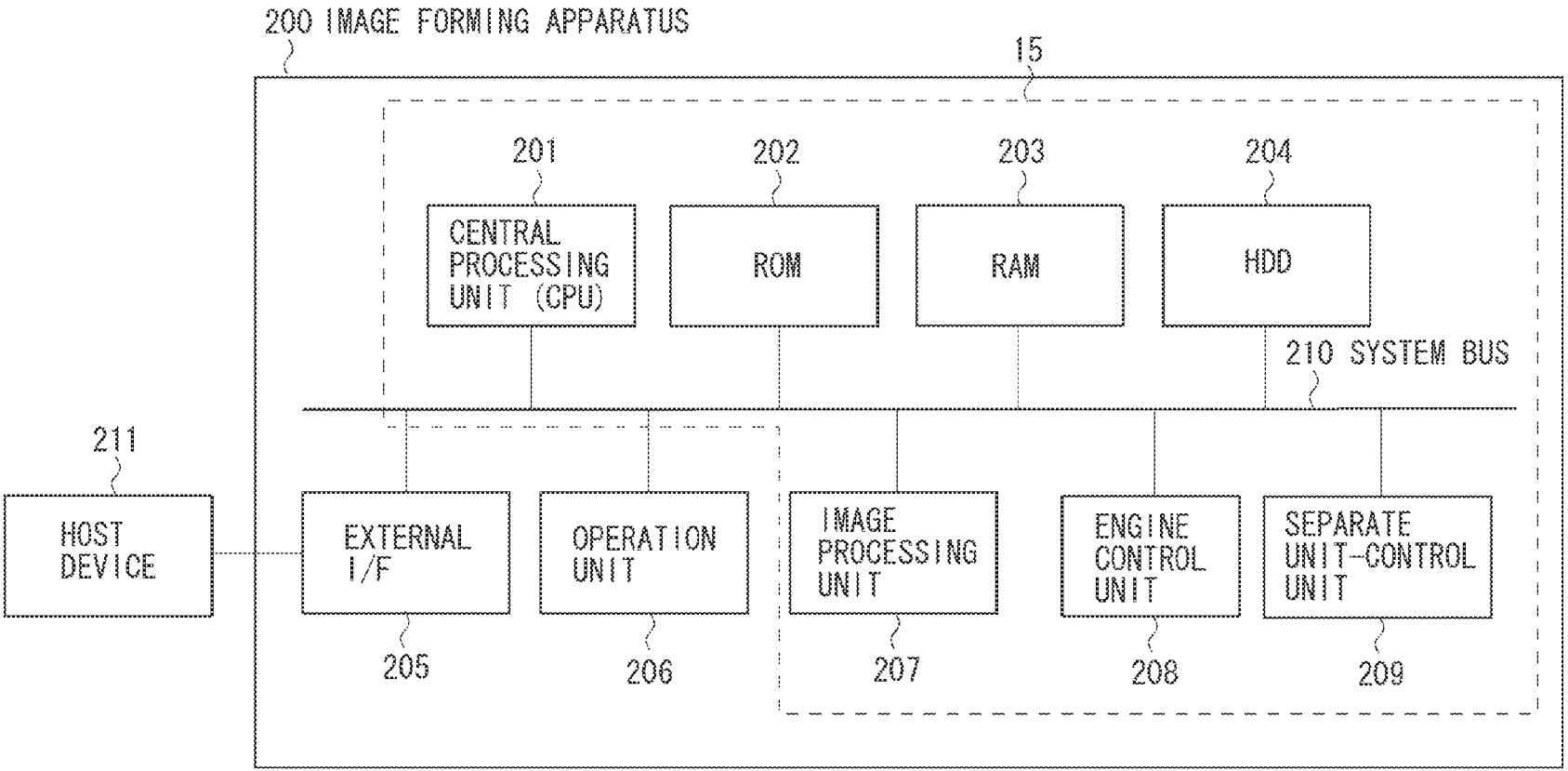
FIG. 3 is a block diagram schematically illustrating a control unit.

FIG. 3 is a block diagram schematically illustrating the control unit 13. The controller 15 (a range enclosed by a dotted line) included in the control unit 13 includes a central processing unit (CPU) 201, a read only memory (ROM) 202, a random access memory (RAM) 203, a hard disk drive (HDD) 204, an image processing unit 207, an engine control unit 208, and a separate unit-control unit 209. The CPU 201 controls an operation of each of the units of the printing apparatus in an integrated way. The ROM 202 stores a program to be executed by the CPU 201 and fixed data necessary for various operations performed by the image forming apparatus. The RAM 203 is used as a work area of the CPU 201 or as a temporal storage area of various types of received data. The RAM 203 also stores various types of setting data. The HDD 204 can store and read out a program to be executed by the CPU 201, print data, and setting information necessary for various operations of the image forming apparatus. An operation unit 206 serves as an input/output interface with a user. The operation unit 206 includes an input unit such as hard keys and a touch panel, a display for displaying information, and an output unit such as an audio generator.

Each of the units, to which a high speed data processing is required, is provided with a dedicated processing unit. The image processing unit 207 performs image processing with respect to print data dealt by the image forming apparatus. The image processing unit 207 converts a color space (e.g., YCbCr) of the input image data into an RGB color space (e.g., sRGB) which is standard in this technical field. The image processing unit 207 provides, as required, various types of processing such as resolution conversion processing, image analysis processing, and image correction processing with respect to the image data. The print data acquired by the above described image processing is stored in the RAM 203 or the HDD 204. The engine control unit 208 performs a drive-control of a print head 14 of the print unit 4 according to the print data based on a control command received from the CPU 201 or the like. The engine control unit 208 also performs a control of the conveyance mechanism of each of the units in the image forming apparatus. The separate unit-control unit 209 is a sub controller for controlling the units such as the sheet supply unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, and the discharge unit 12 respectively. The separate unit-control unit 209 controls an operation of the respective unit based on a command according to the CPU 201. The external interface (I/F) 205 connects the controller to the host apparatus 16. The external interface 205 is a local I/F or a network I/F. The above described configuration elements are connected each other via a system bus 210.

The host apparatus 16 is a supply source of image data which causes the image forming apparatus to perform printing. The host apparatus 16 may be a general computer or may be a dedicated computer. Alternatively, the host apparatus 16 may be a dedicated imaging device including an image capture having an image reader unit, a digital camera, or a photo storage. In a case where the host apparatus 16 is a computer, an operation system (OS), application software for generating image data, a printer driver for image forming apparatus are installed in a storage unit included in the computer. It is not essential that all of the above described processing is realized by the software, but a portion or all of the processing may be realized by the hardware.

Now, a basic operation during the printing operation is described below. A different printing operation is performed in a case of the one-sided print mode and in a case of the two-sided print mode. Therefore, each of the print modes is described below respectively.

Figure 4A:
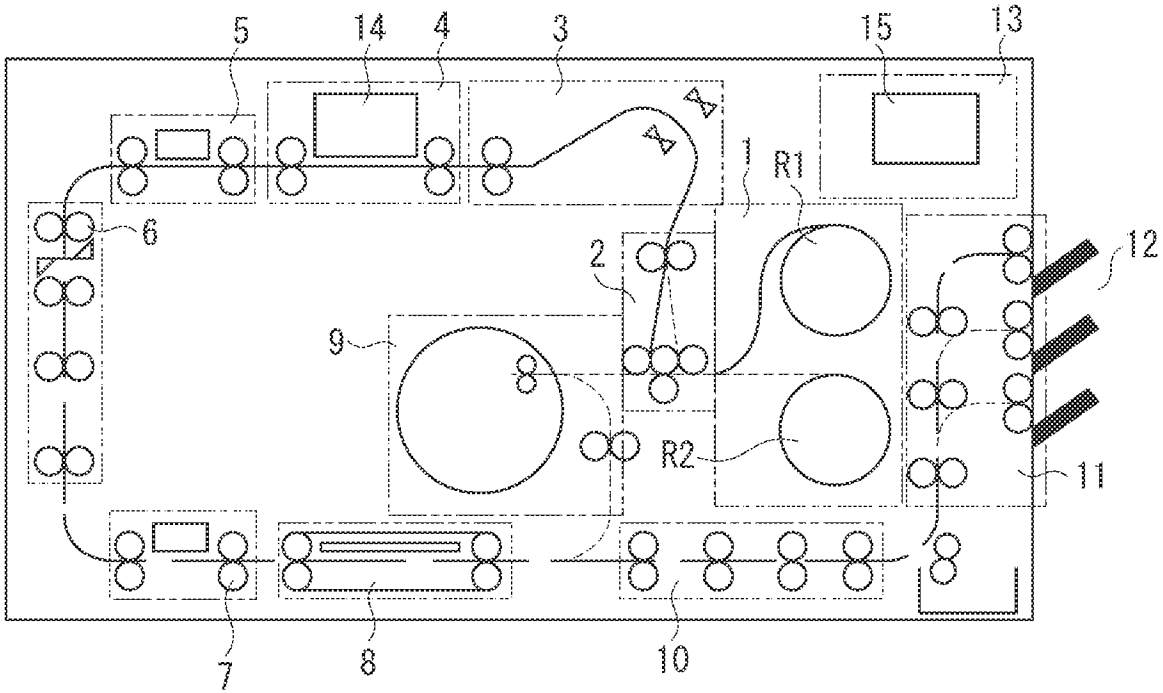
FIGS. 4A and 4B, respectively, illustrate an operation of the image forming apparatus.
Figure 4B:
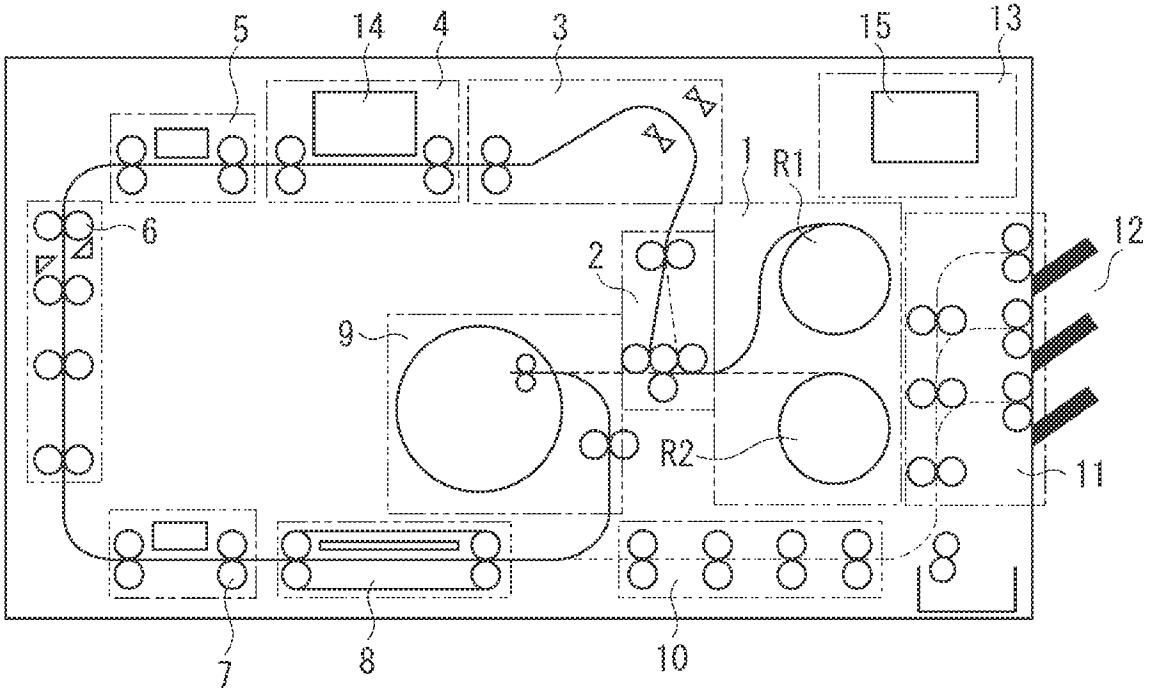

FIGS. 4A and 4B, respectively, illustrates an operation of the image forming apparatus.

FIG. 4A illustrates an operation of the image forming apparatus in the one-sided print mode. FIG. 4A illustrates a conveyance path of the sheet with a solid line. In the conveyance path of FIG. 4A, the sheet supplied from the sheet supply unit 1 is printed to be discharged to the discharge unit 12. The sheet is supplied from the sheet supply unit 1 and processed by each of the decurling unit 2 and the skew correction unit 3, thereafter printing on a front surface (i.e., a first surface) is performed in the print unit 4. An image (i.e., a unit image) having a predetermined unit length in a conveyance direction is sequentially printed to a long continuous sheet, so that a plurality of images is formed side-by-side. The sheet after printed is conveyed to the inspection unit 5 and further to the cutter unit 6 where the sheet is cut for every unit image. Print information is recorded on a rear side of the cut sheet cut for every unit image, as required, by the information recording unit 7. Then, the cut sheet is conveyed to the drying unit 8 one by one and drying is performed. Subsequently, the cut sheets are sequentially discharged to the discharge unit 12 of the sorter unit 11 through the discharge conveyance unit 10, to be stacked on the discharge unit 12. On the other hand, the sheet that remains at a side of the print unit 4 after the last cut of the unit image is returned to the sheet supply unit 1 and taken up by the roll R1 or R2.

As described above, in the one-sided printing, the sheet is processed while the sheet passes through the first path and the third path, whereas, the sheet does not pass through the second path. In view of the above, the following sequence (1) through (6) is executed in the one-sided print mode according to a control by the control unit 13.

(1) The sheet supply unit 1 sends out a sheet and supplies the sheet to the print unit 4;

(2) The print unit 4 prints a unit image on a first surface of the supplied sheet repetitively;

(3) The cutter unit 6 cuts the sheet for every unit image printed on the first surface repetitively;

(4) The sheet after cut for every unit image is passed through the drying unit 8 one by one;

(5) The sheet passed through the drying unit 8 one by one is further passed through the third path to be discharged to the discharge unit 12; and (6) After the last unit image is cut, the sheet remaining at the side of the print unit 4 is returned to the sheet supply unit 1.

FIG. 4B illustrates an operation of the image forming apparatus in the two-sided print mode. In the two-sided printing, the print sequence is performed on a rear surface (i.e., the second surface) after the print sequence is performed on the front surface (i.e., the first surface). In a surface print sequence, an operation of each of the units provided between the sheet supply unit 1 and the inspection unit 5 is the same as the operation of the above described one-sided printing. The sheet is not cut by the cutter unit 6 but is conveyed to the drying unit 8 as it is as the continuous sheet. After the ink of the surface is dried by the drying unit 8, the sheet is guided not to the path at a side of the discharge conveyance unit 10 (i.e., the third path) but to the path at a side of the reversing unit 9 (i.e., the second path). In the second path, the sheet is taken up by the take-up rotator of the reversing unit 9 which rotates in a forward direction (i.e., in a counterclockwise direction in FIG. 4B). In the print unit 4, when the predetermined printing is completed with respect to the front surface, the trailing edge of the print area of the continuous sheet is cut by the cutter unit 6. The continuous sheet of the downstream side, with reference to a cutting position, in the conveyance direction (i.e., the side where the sheet is printed) is taken up to the sheet trailing edge (i.e., the cutting position) by the reversing unit 9 through the drying unit 8. On the other hand, at the same time the sheet is taken up, the continuous sheet remained at the upstream side with reference to a cutting position in the conveyance direction (i.e., the side of the print unit 4) of the cutting position is rewound by the sheet supply unit 1 so that the sheet leading edge (i.e., the cutting position) does not remain in the decurling unit 2. As a result, the sheet is taken up by the roll R1 or R2. Since the continuous sheet is rewound, an impact between the continuous sheet and the sheet which is resupplied in the print sequence for the rear surface as described below can be prevented.

After the above described print sequence for the front surface, the sequence is switched to the print sequence for the rear surface. The take-up rotator of the reversing unit 9 rotates in a direction (i.e., in a clockwise direction in FIG. 4B) opposite to the direction of taking up. An end of the taken-up sheet (i.e., the sheet rear end when the sheet is taken up becomes a sheet leading edge when the sheet is sent out) is sent out to the decurling unit 2 along the path illustrated by a dotted line. The curled state provided by the take-up rotator is corrected by the decurling unit 2. In other words, the decurling unit 2 is provided between the sheet supply unit 1 and the print unit 4 in the first path and between the reversing unit 9 and the print unit 4 in the second path respectively. In the paths, the common decurling unit 2 is disposed in order to decurl the sheet. The reversed sheet is conveyed through the skew correction unit 3 to the print unit 4 where the rear surface of the sheet is printed. Thus printed sheet is cut for every predetermined unit length preliminarily set by the cutter unit 6 after the printed sheet passes through the inspection unit 5. The cut sheet is cut into a plurality of printed matters by the cutter unit 6. Since a front surface and a rear surface of each of thus cut printed matters are provided with an image, no recording is performed by the information recording unit 7. The cut sheet is conveyed to the drying unit 8 one by one and sequentially discharged to the discharge unit 12 of the sorter unit 11 through the discharge conveyance unit 10, to be stacked in the discharge unit 12.

As described above, in the two-sided printing, the sheet is processed while the sheet passes through the first path, the second path, the first path, and the third path in this order. In view of the above, in the two-sided print mode, the following sequence including steps (1) through (11) is executed according to a control by the control unit 13.

(1) The sheet supply unit 1 sends out the sheet and supplies the sheet to the print unit 4;

(2) The print unit 4 prints the unit image onto the first surface of thus supplied sheet repetitively;

(3) The sheet of which the first surface is printed is caused to pass through the drying unit 8;

(4) The sheet passed through the drying unit 8 is guided to the second path in order to be taken up by the take-up rotator of the reversing unit 9;

(5) After repetitive printing onto the first surface is completed, the sheet is cut by the cutter unit 6 at a trailing edge of the unit image that is finally printed;

(6) An end of the cut sheet passes through the drying unit 8 and the cut sheet is taken up by the take-up rotator until the end of the cut sheet reaches the take-up rotator. At the same time, the sheet remained at a side of the print unit 4 after the sheet is cut is returned to the sheet supply unit 1;

(7) After the sheet is taken up, the take-up rotator is reversely rotated to supply the sheet again to the print unit 4 through the second path;

(8) A unit image is repetitively printed by the print unit 4 onto the second surface of the sheet that is supplied from the second path;

(9) The sheet is repetitively cut by the cutter unit 6 for every unit image printed on the second surface;

(10) The sheet cut for every unit image is caused to pass through the drying unit 8 one by one; and

(11) The sheet passed through the drying unit 8 one by one is discharged to the discharge unit 12 through the third path.

Now, an inspection method of defective discharge and an inspection method of tint in the printer apparatus having the above described configuration are described below.

First of all, the conventional detection method of defective discharge, which does not require the drying processing of ink, is described below.

Figure 5:
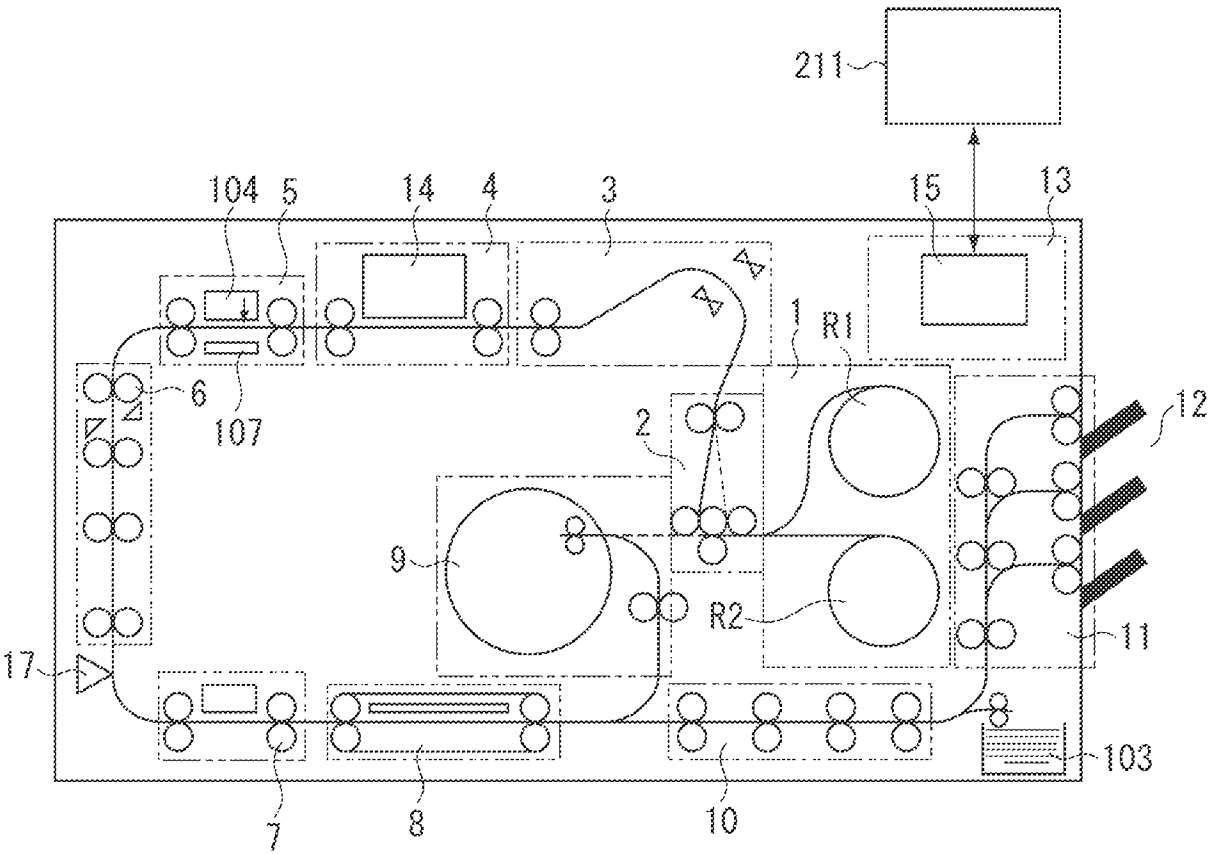
FIG. 5 illustrates a paper feeding path of the present invention in its entirety.

FIG. 5 illustrates an entire paper feeding path of the present invention. A trash box 103 is used for discarding a paper, which the inspection unit 5 determines as a defectively printed paper or a unnecessary paper on which various types of patterns are printed and is used in the image inspection processing.

Figure 6:
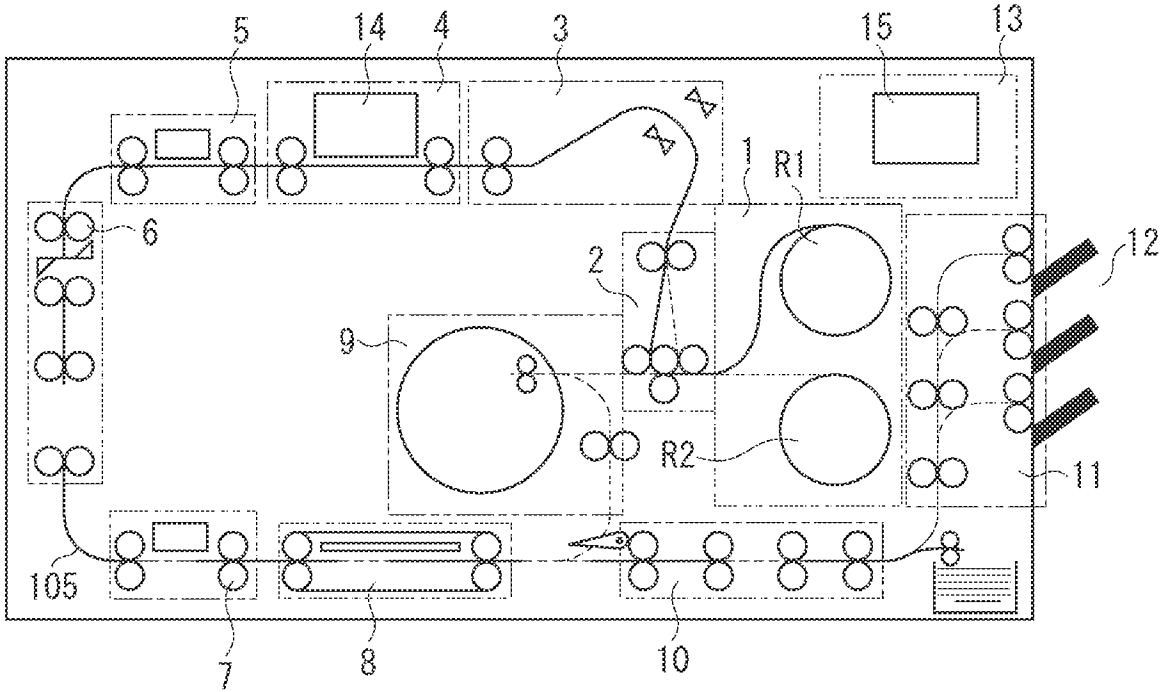
FIG. 6 illustrates a case where an inspection pattern of defective discharge for example is read out in which drying processing is not required.
Figure 7:
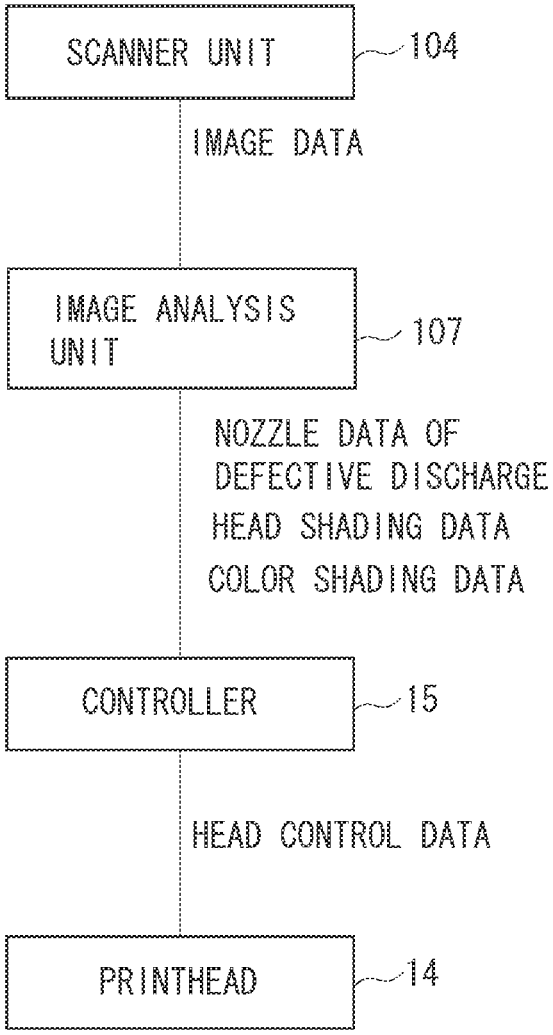
FIG. 7 is a block diagram illustrating a configuration relating to reading out of the inspection pattern.
Figure 8:
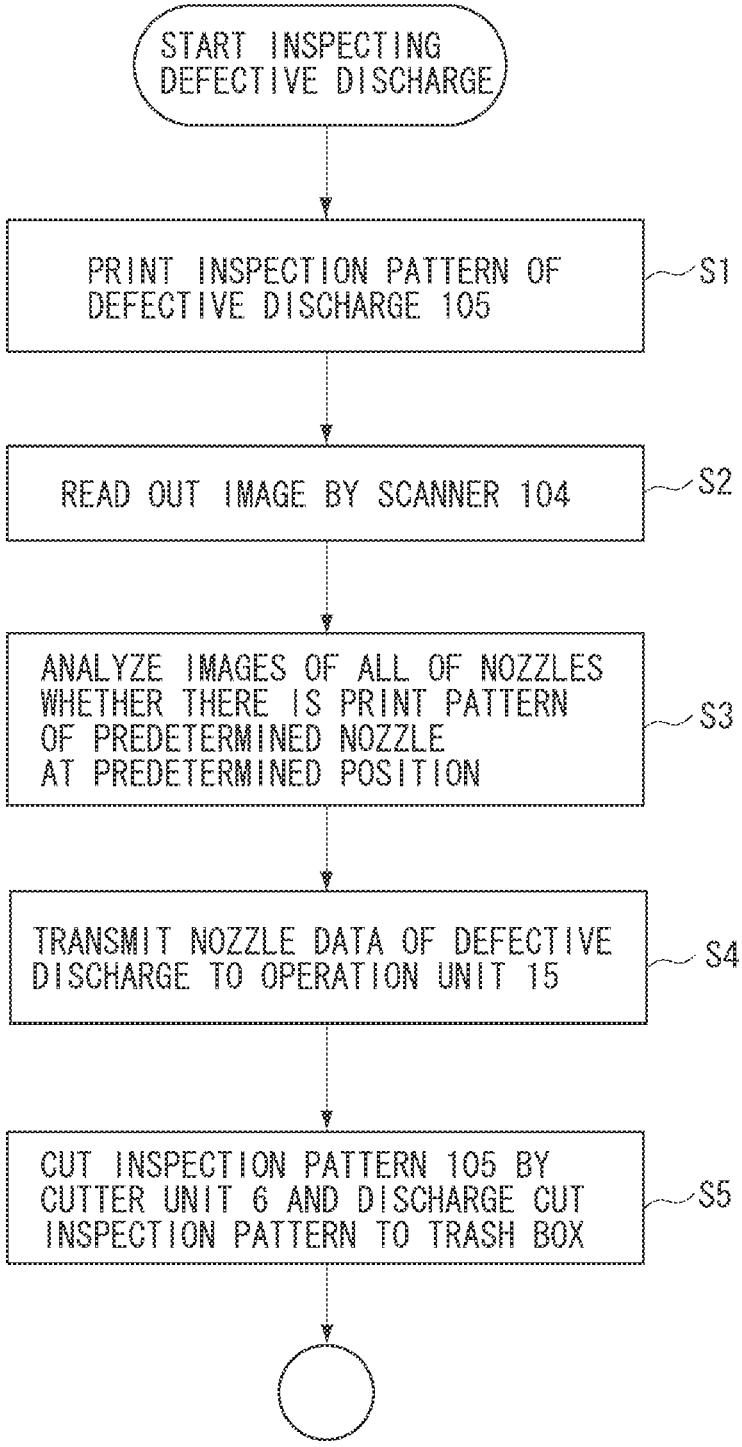
FIG. 8 is a flow chart of an inspection of defective discharge.

FIG. 6 illustrates a case where an inspection pattern of defective discharge in which drying processing is not required is read out. FIG. 7 is a block diagram illustrating a configuration relating to reading of the inspection pattern. FIG. 8 is a flow chart of inspecting the defective discharge. In a case where the defective discharge is inspected, since the drying processing is not required as described above, the inspection pattern is read out by the scanner unit 104 after the inspection pattern is printed and an image thereof is analyzed by the image analysis unit 107. The inspection pattern after read out is no longer necessary, so that the sheet including the inspection pattern is cut by the cutter unit 6 to be disposed into the trash box 103.

Figure 9:
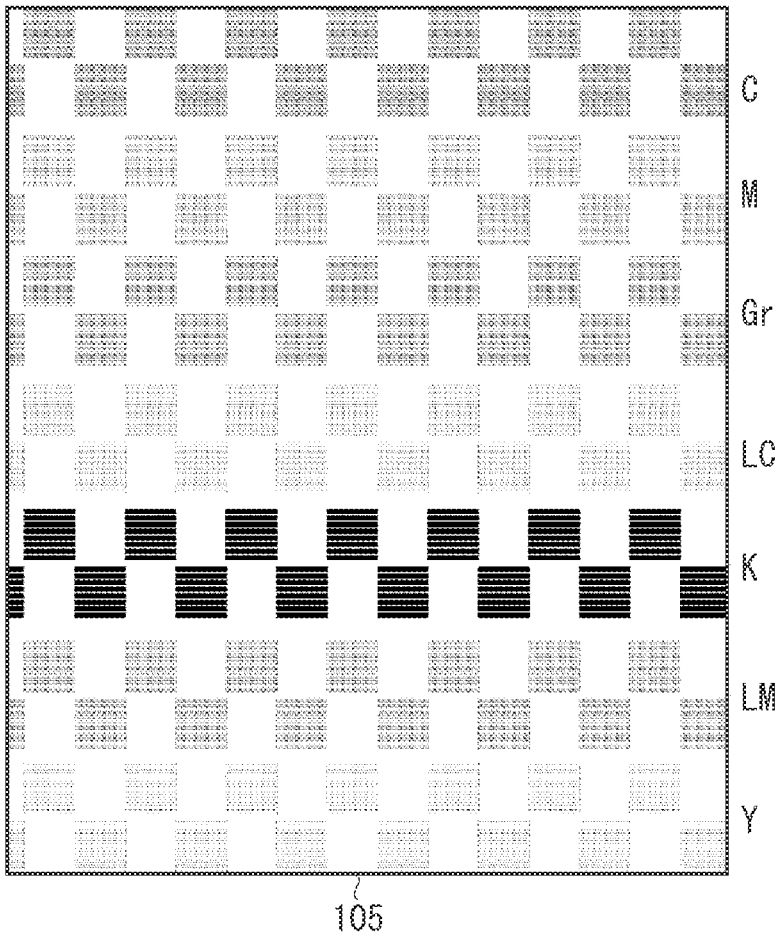
FIG. 9 is an example of the inspection pattern of defective discharge.
Figure 10:
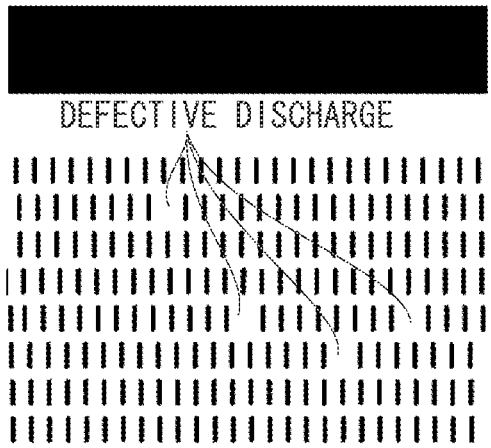
FIG. 10 is an enlarged view of the inspection pattern of defective discharge.

Explanation is made with reference to the flow chart of FIG. 8. In step S1, an inspection pattern of defective discharge is printed by the print unit 4 with respect to a paper passed through the sheet supply unit 1, the decurling unit 2, and the skew correction unit 3. In step S2, the inspection pattern of defective discharge is read out by the inspection unit 5 after the inspection pattern is printed. FIG. 9 illustrates an example of the inspection pattern of defective discharge 105. FIG. 10 illustrates a partially enlarged view of FIG. 9. In FIG. 10, each line is drawn by an ink discharged from a predetermined single nozzle port. Portions where no lines are drawn are areas of discharge failure i.e., inks are not discharged from the nozzles. In other words, the portions are areas of defective discharge. In step S3, thus read out inspection pattern of defective discharge is analyzed to acquire inspection data. Which number of the nozzle is the nozzle of defective discharge is specified based on image information read out by the scanner 104 of the inspection unit 5. In the present exemplary embodiment, there are about 800,000 nozzles. In order to inspect the 800,000 nozzles one by one, about 500 mm length of the inspection pattern of defective discharge is necessary. In step S4, nozzle data of defective discharge is transmitted.

Subsequently, analysis is performed as to what degree of density the defective discharge occurs from the nozzle numbers of defective discharge. In a case where the density of defective discharge is less than a predetermined value, the number of discharges from the neighboring nozzles is increased in order to complement the defective discharge. In a case where the density of defective discharge is equal to or more than the predetermined value, the CPU 201 determines that the complement cannot be achieved and thus tries to eliminate the defective discharge by cleaning, suction, and forcible discharge of the nozzles. Then, the inspection of defective discharge is performed again and, if the density of defective discharge becomes less than the predetermined value, the above described complement of the defective discharge is performed, resulting in restart of the printing operation. In a case where the density of defective discharge is still equal to or more than the predetermined value, the CPU 201 causes to display a screen indicating a printer error, thereby causing the user to stop the printing operation.

Although a detailed explanation is omitted here, in a case where correction is performed after checking whether an ink droplet flies to a predetermined position from the nozzle, i.e., in a case of detecting impact precision, the drying processing is not required since a condition of the tint can be ignored here.

In step S5, the inspection pattern of defective discharge, after the inspection pattern is read out and sent to the cutter unit 6, is cut. Thus cut inspection pattern is conveyed so as to pass through the information recording unit 7, the drying unit 8, and the discharge conveyance unit 10, to be discharged into the trash box 103.

Now, an inspection of tint is described below. The printer according to the present exemplary embodiment is an in-line type printer in which print heads having a plurality of chips are aligned beyond a paper width. In the in-line type printer, if nothing is done, an amount of discharged ink varies in each chip and thus a density difference occurs between the neighboring connection portions. Also, even within the same chip, since the amount of discharge varies, a uniform density cannot be obtained if a discharge power is not varied nozzle by nozzle. In order to reproduce the density, an error diffusion method or the like is used. However, it is hard to obtain perfect density linearity. More specifically, there are many cases that a color includes a second color and a third color which are hard to be reproduced in a case where a plurality of inks are mixed.

These colors are readout by the scanner and an amount of discharged ink is controlled finely, thereby reproducing an exact color. More specifically, such control can be achieved by the head shading, the color shading, and the Pulse Width Modulation (PWM) control.

According to the PWM control, general power applied to a print head chip is controlled and an average amount of discharged ink is controlled per a nozzle chip unit. In the head shading, ink discharge energy of the sum of a unit of several numbers of nozzles is controlled and a discharge pattern of error diffusion is controlled. Accordingly, the density linearity is controlled. In the color shading, the second color and the third color are inspected to control the amount of discharged ink from the nozzles based on information obtained by comparing the inspection result with color information to be applied to the printer, thereby performing matching of color.

In detecting the tint for the sake of the above described controls, not a high resolution but a high gradation is required for scanner. More specifically, 8 bit/pixel is enough in detecting the defective discharge, whereas 16 bit/pixel is required in detecting the tint.

More important is the drying processing of inks. In a case of an ink-jet type printer, an exact color cannot be reproduced before inks landed on a paper are dried. More specifically, when reading out the tint, data becomes meaningless if the inspection pattern is directly read out immediately after the paper is printed.

In the present exemplary embodiment, in order to read out the inspection pattern under the condition that an exact color is reproduced after the inks are dried, the drying unit 8 included in the printer is used. A configuration and steps for detecting the tint using the drying unit 8 are described below.

Figure 13:
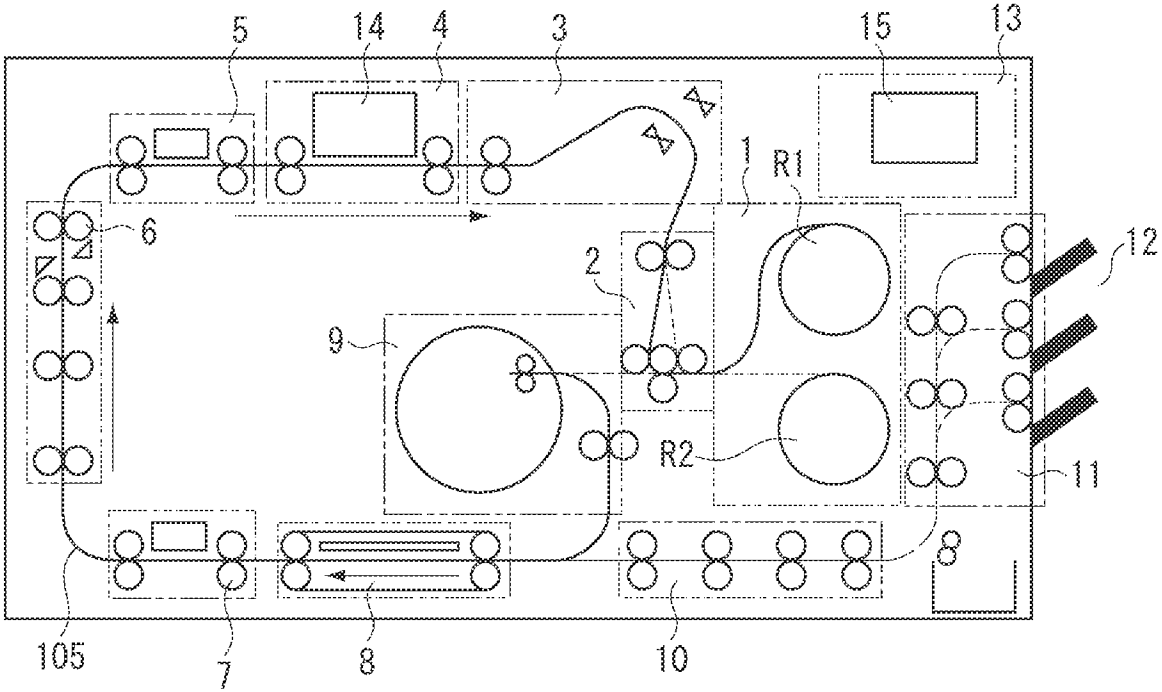
FIG. 13 illustrates further another case where an inspection pattern of tint is read out in which drying processing is required.
Figure 14A:
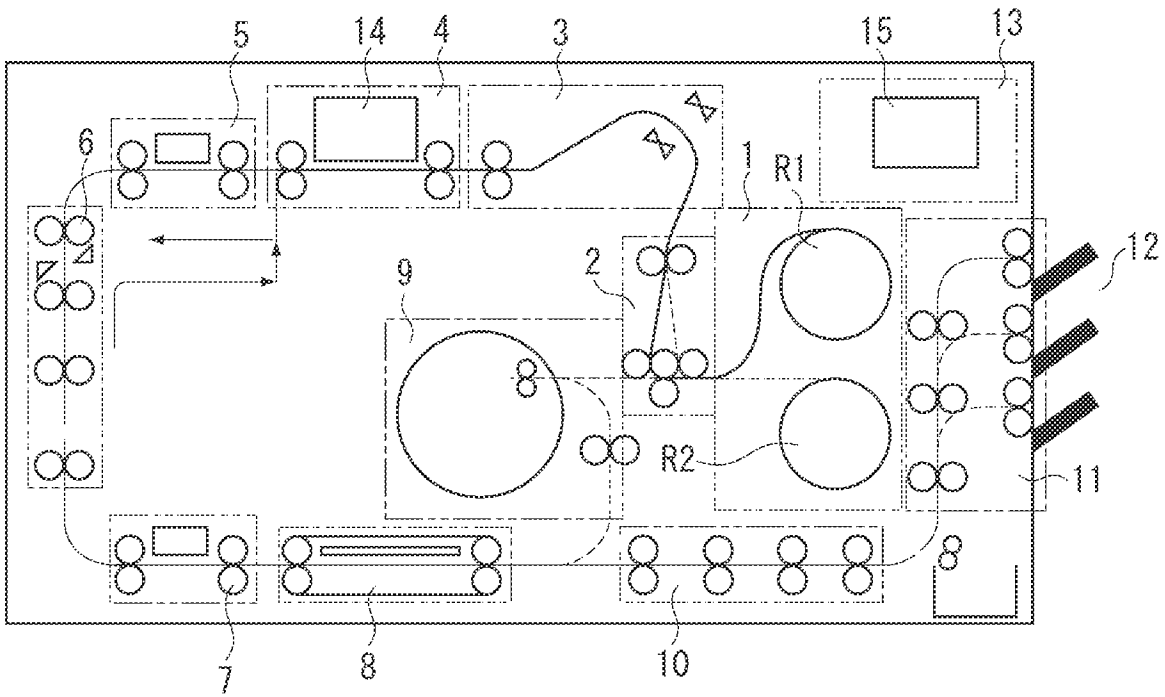
FIGS. 14A and 14B, respectively, illustrate yet another case where an inspection pattern of tint is read out in which drying processing is required.
Figure 14B:
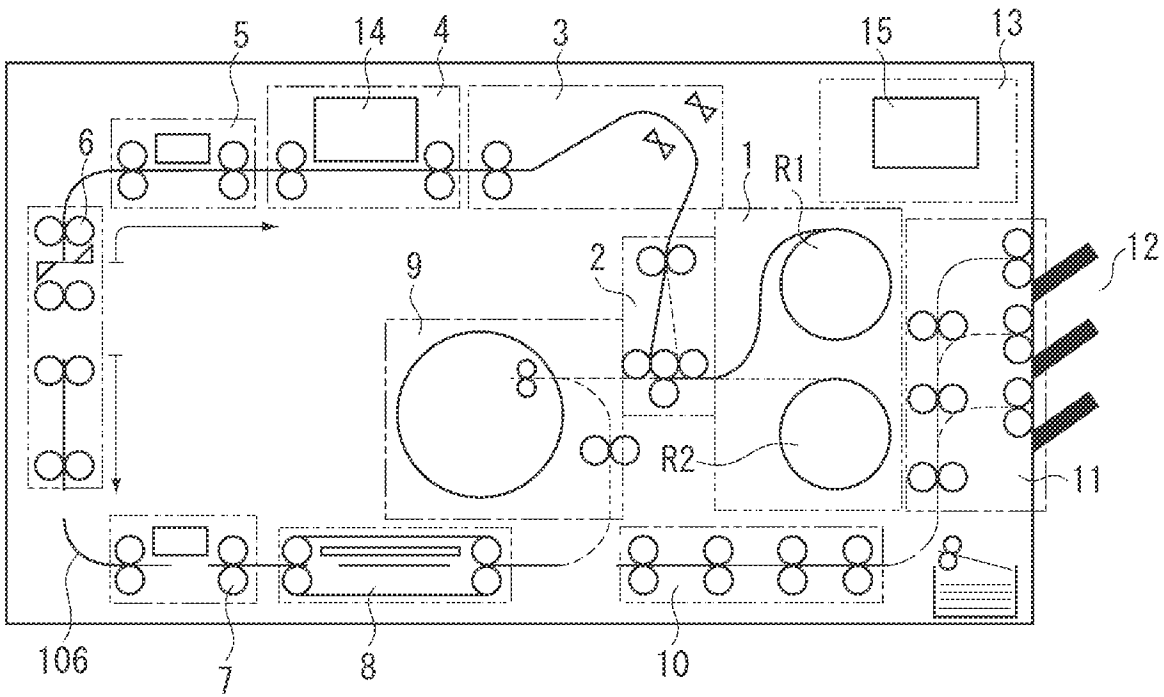
Figure 15:
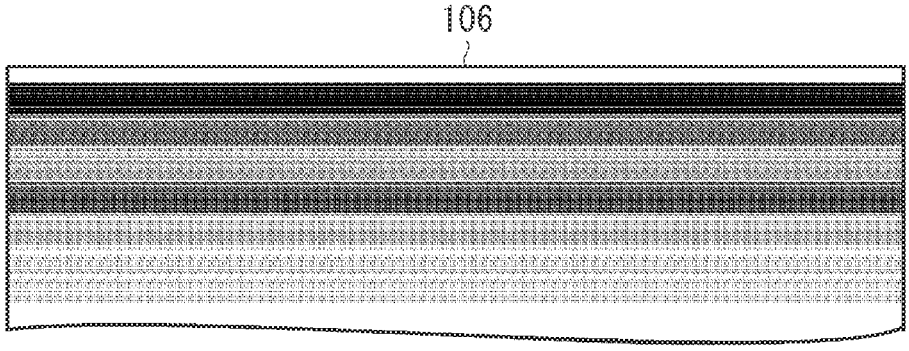
FIG. 15 illustrates an example of an inspection pattern of tint.
Figure 16:
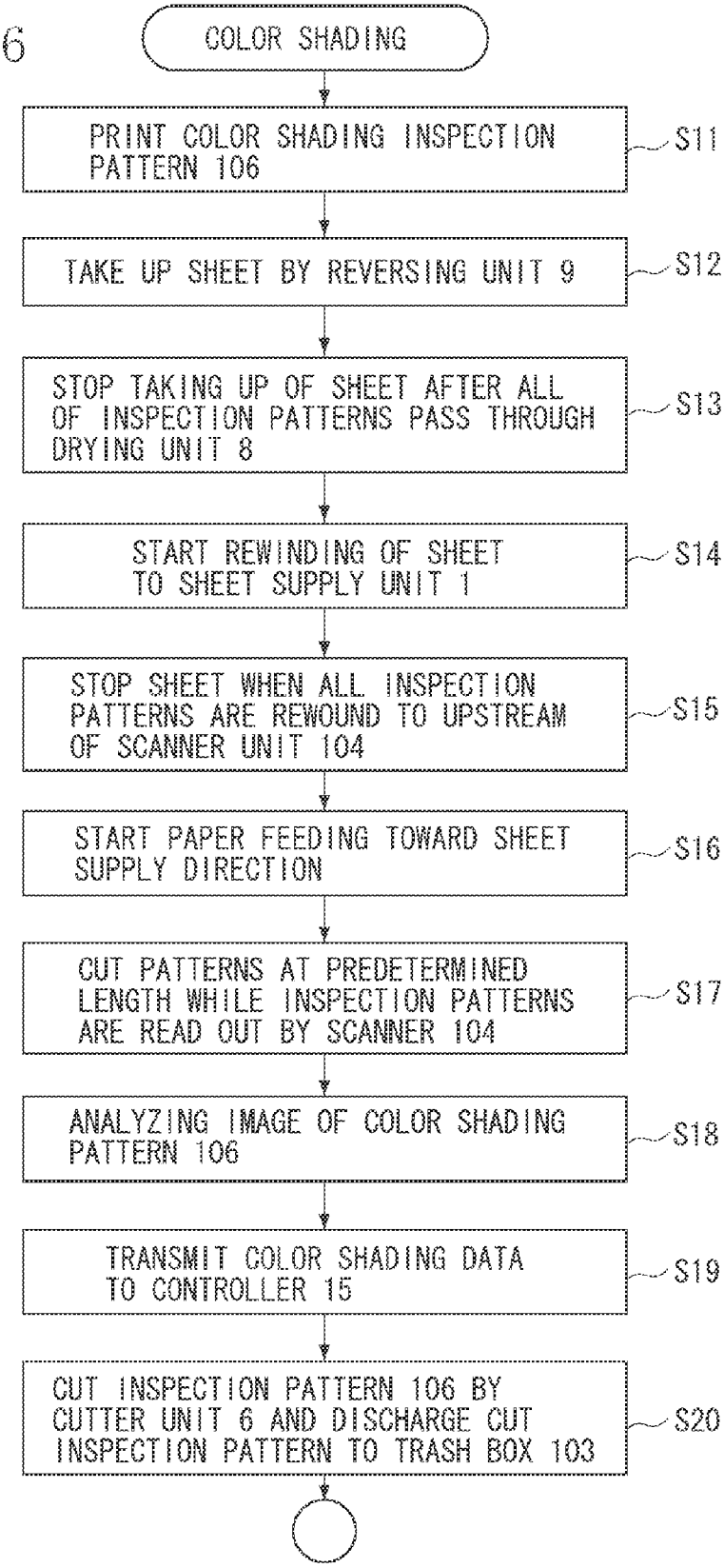
FIG. 16 is a flow chart of color shading.

FIGS. 11, 12, 13, 14A, and 14B, respectively, illustrates an operation to read out a tint inspection pattern that is to be dried. FIG. 16 is a flow chart of the color shading. FIG. 15 illustrates a tint inspection pattern 106 for detecting a color difference of a single color between aligned print heads.

Figure 11:
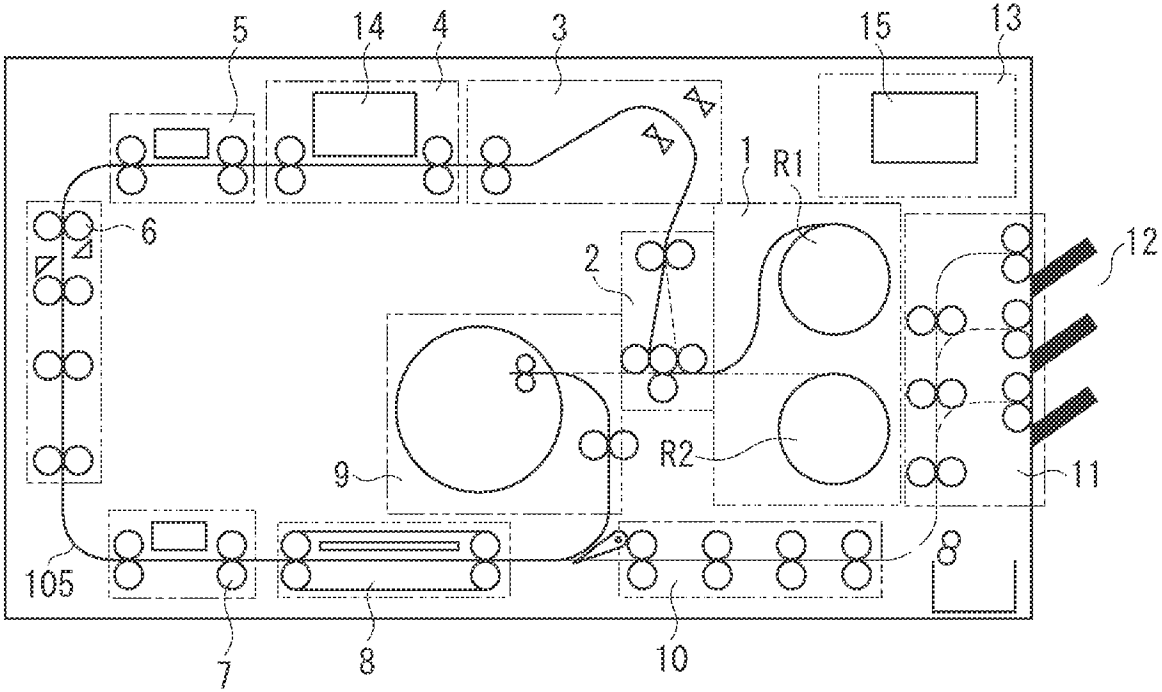
FIG. 11 illustrates a case where an inspection pattern of tint is read out in which drying processing is required.
Figure 12:
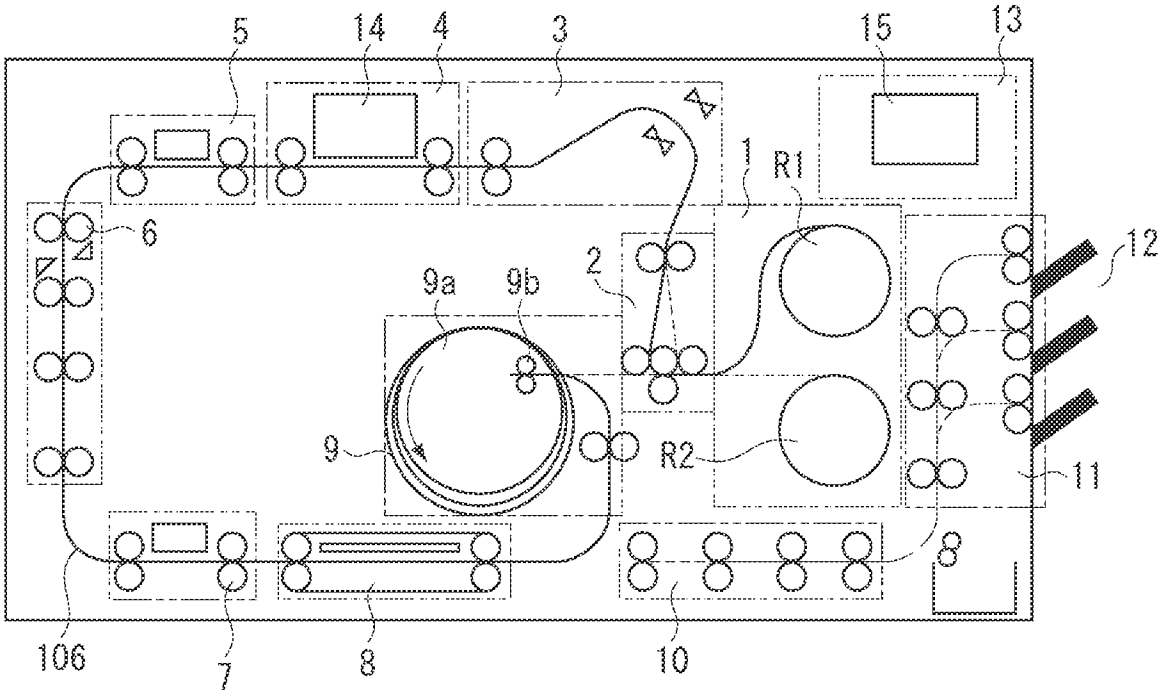
FIG. 12 illustrates another case where an inspection pattern of tint is read out in which drying processing is required.

In step S11, the print unit 4 prints the tint inspection pattern 106 onto the sheet passed through the sheet supply unit 1, the decurling unit 2, and the skew correction unit 3. In step S12, the sheet on which the tint inspection pattern 106 is printed is taken up by the reversing unit 9. The sheet on which the tint inspection pattern 106 is printed is conveyed so as to pass through the cutter unit 6 and the information recording unit 7. The sheet is then guided to the reversing unit 9 after the ink on the sheet is dried in the drying unit 8. The above state is illustrated in FIG. 11. A leading edge of the sheet thus conveyed is pinched between a roller pair 9*b* provided to the drum 9*a* of the reversing unit 9 (illustrated in FIG. 12). Under the condition that the leading edge of the sheet is pinched by the roller pair 9*b*, the drum 9*a* is rotated in a counterclockwise direction as it is illustrated in FIG. 12, thereby causing the sheet to be taken up around an outer circumference of the drum 9*a*. In step S13, after all of the inspection patterns pass through the drying unit 8, the rotation of the drum 9*a* is stopped. In step S14, the drum 9*a* is rotated in the clockwise direction in order to rewind the sheet. Thus rewound sheet is conveyed in an opposite direction by a conveyance unit of each of the units such that the sheet passes through the drying unit 8, the information recording unit 7, the cutter unit 6, and the print unit 4. Then, the sheet is taken up by the sheet supply unit 1. The above state is illustrated in FIG. 13. In step S15, the conveyance of the sheet in the opposite direction is stopped when all the inspection patterns are rewound to the upstream of the scanner unit 104. Then, the processing proceeds to step S16 where, as it is illustrated in FIG. 14A, the inspection patterns are conveyed toward the inspection unit 5. Subsequently, the processing proceeds to step S17 where the scanner 104 reads out the inspection patterns while the cutter unit 6 cuts inspection patterns of the sheet into a predetermined length.

In step S18, image information of the inspection patterns, which is readout by the scanner 104 of the inspection unit 5, after the ink of the inspection patterns are dried, is analyzed by the image analysis unit 107 (illustrated in FIG. 5) in order to acquire inspection data. In step S19, the inspection data (i.e., the color shading data) is transmitted to the controller 15. The inspection pattern 106 cut in step S20 is discharged into the trash box 103. The above state is illustrated in FIG. 14B. The controller 15 acquires a control parameter of the print head by analyzing the inspection patterns.

In the subsequent processing for forming an image onto the sheet, the operation unit 15 controls an amount of discharged ink discharged by each of the nozzles of the print head based on the control parameter of the print head acquired in the analysis of the inspection patterns, resulting in adjustment of the tint. More specifically, as it is described above, the head shading, the color shading, and the PWM control are performed.

The CCD 108 used in the scanner unit 104 according to the present exemplary embodiment is configured to perform an analogue adder of a pixel by using a charge-transfer register. For example, Japanese Patent Laid-open Publication No. 2006-340406 discusses this technique. With a use thereof, the number of stored electrons can be increased with low resolution. In other words, with the low resolution, a high gradation reading can be realized with a same amount of light as that in the high resolution. Therefore, two modes, i.e., the high resolution mode including a lot of noises and the low resolution mode including less noise, can be switched over to each other. In the present exemplary embodiment, a high resolution mode is used in the inspection of defective discharge which requires high resolution illustrated in FIG. 8, whereas a low resolution mode is used in the head shading and the color shading which requires low resolution and high gradation illustrated in FIG. 16. By using the above, in the present exemplary embodiment, it becomes possible to reduce the number of scanner unit 104 to one, which contributes to a down-sizing of the printer.

After an inspection pattern for inspecting a density difference of a single color for the head shading is recorded by the print unit 4, in addition to that for the color shading, in the same manner as it is done for the color shading, the inspection pattern is dried by the drying unit 8 to enable the inspection pattern to be read by the scanner of the inspection unit 5. An analysis of thus read image information after the ink is dried shows a control parameter of the print head. Thereby the tint, i.e., the amount of discharged ink, of the printer can be controlled.

The control unit of above described exemplary embodiment may controls such that when the inspection pattern is a pattern for inspection of defective discharge the reading unit reads the inspection pattern on the sheet before the sheet on which the inspection pattern is recorded passes through the drying unit, and when the inspection pattern is a pattern for inspection of tint the reading unit reads the inspection pattern on the sheet after the sheet on which the inspection pattern is recorded passes through the drying unit.

In the above described exemplary embodiment, the drying unit 8 is arranged at the downstream side of the cutter unit 6. However, the drying unit 8 may be arranged at the upstream side of the cutter unit 6.

In the present exemplary embodiment of the present invention, defective discharge is detected before the drying processing. However, the inspection pattern of defective discharge may be printed at the same time the inspection pattern of tint is printed and both of the inspection patterns may be inspected after they are dried.

Further, in the present exemplary embodiment, the inspection pattern is started to be read out after all of the patterns are rewound. However, the inspection patterns may be readout from an opposite direction at the same time as rewinding the inspection patterns for the sake of shortening of the rewinding time.

The present exemplary embodiment is made on the assumption that a rewinding rate is set to the same rate as a paper feeding rate. However, if an enough drying time cannot be obtained at the drying unit 8 in detecting the tint, the rewinding rate can be set slower in order to obtain the enough drying time.

As described above, data for adjusting the tint can be obtained automatically in the present exemplary embodiment. Since the recorded inspection pattern is dried by the drying apparatus built in the printer, data for adjusting the tint can be obtained within a short time period. Therefore, a scanner is built in the printer to perform the inspection of the defective discharge, the inspection of the landing position, the inspection of the tint, and the inspection of the difference of tint. Accordingly, without human hand, a complete automatic inspection of the printer can be realized and a good printing quality of the printer can be achieved. Further, according to the present exemplary embodiment, an external device such as an external scanner is not required, and thus the user does not need to learn an operation of the external scanner apparatus and a space for setting the external scanner apparatus can be saved. In view of the above, a simple operation without an operation of an externally assisting apparatus can be realized.

Further, since the scanner can be switched between the high resolution mode and the high gradation mode, the number of the built-in scanner can be set to one, thereby enabling further downsizing of the apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-042351 filed Feb. 26, 2010, which is hereby incorporated by reference herein in its entirety.

What is claimed is:

1. An image forming apparatus, comprising:

a supply unit configured to supply a sheet;

a recording unit configured to perform recording images or patterns by applying ink onto the sheet supplied from the supply unit;

a reading unit, provided downstream of the recording unit, configured to read out the patterns on the recorded sheet;

a drying unit, provided downstream of the reading unit, configured to dry the recorded sheet;

a holding unit, provided downstream of the drying unit, configured to hold the sheet; and a control unit configured to control the apparatus for an inspection or a correction for color recording by the recording unit, such that the recording unit records the patterns on the sheet; the drying unit dries the recorded sheet; the holding unit temporarily holds the dried sheet, then the sheet is conveyed toward upstream from the holding unit; the drying unit dries the sheet again; and the reading unit reads out the patterns on the sheet.

2. The image forming apparatus according to claim 1, wherein the inspection pattern is adapted to inspect a tint.

3. The image forming apparatus according to claim 2, wherein, in a case where the inspection pattern is adapted to inspect failure of ink discharge by the recording unit, the control unit causes, without allowing the sheet on which the inspection pattern is recorded by the recording unit to pass through the drying unit, the reading unit to read out the inspection pattern in order to acquire inspection data.

4. The image forming apparatus according to claim 1, wherein the supply unit holds the sheet as a rolled continuous sheet and draws out the rolled sheet when supplying the sheet to the recording unit, and when the sheet is conveyed in the opposite direction, the supply unit draws back the sheet by rotating the rolled sheet reversely.

5. The image forming apparatus according to claim 1, wherein the control unit controls the apparatus for recording images, such that the recording unit records a plurality of images in sequence onto the sheet supplied from the supply unit and the drying unit dries the recorded sheets.

6. The image forming apparatus according to claim 1, wherein the holding unit comprises a rotary member which winds the sheet when holding it and rewinds the sheet held by the rotary member when the sheet is conveyed toward upstream from the holding unit.

7. The image forming apparatus according to claim 1, wherein the sheet is conveyed downstream when the reading unit reads out the patterns.

8. The image forming apparatus according to claim 1, further comprising a cutting unit, provided between the recording unit and the drying unit, configured to cut the sheet, wherein the control unit controls the apparatus for performing two-sided printing, such that the recording unit records a plurality of images in sequence on a first surface of the sheet supplied from the supplying unit;

the holding unit holds the sheet with the images recorded on the first surface, then supplies the sheet to the recording unit again;

the recording unit records a plurality of images on a second surface of the sheet which is back side of the first surface;

the cutting unit cuts the sheet of which the images are recorded on both the first surface and second surface; and the drying unit dries the cut sheets.

9. The image forming apparatus according to claim 1, wherein the control unit controls an amount of discharged ink discharged from each of the ink discharge ports of the recording unit based on thus acquired inspection data.

10. The image forming apparatus according to claim 9, wherein the control unit controls an average amount of discharged ink per each nozzle chip of the recording unit based on thus acquired inspection data.

11. The image forming apparatus according to claim 9, wherein the control unit controls ink discharge energy of the sum of a plurality of nozzles based on thus acquired inspection data.

12. The image forming apparatus according to claim 9, wherein the control unit controls a discharged ink amount of the nozzles based on data acquired by a comparison between a color generated by mixing a plurality of inks read from the inspection pattern and color information of the inspection pattern.

13. The image forming apparatus according to claim 1, wherein the control unit inspects colors in accordance with the reading of the patterns, and controls ink discharge of an inkjet head provided in the recording unit for the color recording in accordance with the inspection.

14. An image forming apparatus, comprising:

a supply unit configured to supply a sheet;

a recording unit configured to perform recording images or patterns by applying ink onto the sheet supplied from the supply unit;

a reading unit configured to read out the patterns on the recorded sheet;

a drying unit configured to dry the recorded sheet;

a cutting unit configured to cut the sheet;

a holding unit having a rotary member configured to hold the sheet; and a control unit configured to control the apparatus, wherein the control unit controls the apparatus for an inspection or a correction for color recording by the recording unit, such that the recording unit records the patterns on the sheet; the drying unit dries the recorded sheet; the holding unit holds the dried sheet by rotating the rotary member to roll up the dried sheet then making the rotary member reverse rotation to supply the sheet to the reading unit; and the reading unit reads out the patterns on the sheet supplied from the holding unit, wherein the control unit controls the apparatus for performing two-sided printing, such that the recording unit records a plurality of images in sequence on a first surface of the sheet supplied from the supplying unit, wherein the holding unit holds the sheet with the images recorded on the first surface by rotating the rotary member to roll up the sheet;

the holding unit supplies the sheet to the recording unit again by making the rotary member reverse rotation, wherein the recording unit records a plurality of images on a second surface of the sheet which is back side of the first surface, wherein the cutting unit cuts the sheet of which the images are recorded on both the first surface and second surface, and wherein the drying unit dries the cut sheets.

15. The image forming apparatus according to claim 14, wherein the control unit inspects colors in accordance with the reading of the patterns, and controls ink discharge of an inkjet head provided in the recording unit for the color recording in accordance with the inspection.

* * * * *